United States Patent [19]

Stahl et al.

[11] 4,391,369

[45] Jul. 5, 1983

[54] FOUR-LEVEL STACKING CONTAINER

[75] Inventors: Edward L. Stahl, Brighton; Elsmer W. Kreeger, Allegan, both of Mich.

[73] Assignee: Pinckney Molded Plastics, Inc., Pinckney, Mich.

[21] Appl. No.: 298,063

[22] Filed: Aug. 31, 1981

[51] Int. Cl.[3] ..... B65D 21/06

[52] U.S. Cl. ..... 206/506

[58] Field of Search ..... 206/506

[56] References Cited

FOREIGN PATENT DOCUMENTS 1131652 2/1957 France ..... 206/506

2067167 7/1981 United Kingdom ..... 206/506

*Primary Examiner*—George E. Lowrance

*Attorney, Agent, or Firm*—Basile, Weintraub & Hanlon

[57] ABSTRACT

A four-level stacking container includes bale members mounted on each of two opposed end walls by pivot pins received in slots in the end walls. The configuration of the slots are such that the bale member pivot pins may be located in either of at least two stable rest positions within the slots and the bale member may be pivoted to either of two rest positions relative to the end walls for each stable rest position of the pivot pin. The four rest positions thus established accommodate the stacking of a like container in a first container at any one of four different elevations relative to the first container.

3 Claims, 6 Drawing Figures

62'
52'
54'
58'
10'
64'
46
44
56
60
62
52
50
54
48
58
10
64
56
60

FOUR-LEVEL STACKING CONTAINER

BACKGROUND OF THE INVENTION

The present invention relates to stacking containers in which like containers may be stacked one on top of the other at different levels. The capability of stacking the containers at different levels relative to each other is to minimize the space required to hold a group of the containers when the containers are emptied or when products of different height are carried in the containers.

For example, a bakery may wish to transport large numbers of baked goods within a truck or trailer whose cargo space has a height of nine feet. Where the containers are loaded with loaves of bread, the containers must be stacked at levels relative to each other so that the bread is not crushed by the bottom of the next uppermost container. However, other products may be of a height less than that of a loaf of bread and containers of such other products, if stacked in the same vertical relationship as when the containers carried bread, would result in a substantial wastage of cargo space. For this reason, the prior art has produced containers of the type in which the present invention is concerned which are so-called three-level containers.

These three-level containers are so constructed that the containers, when empty, can be nested in a fully nested position in which a stack of containers will be of a minimum height. This is one level of the so-called three-level container. Various arrangements are provided so that the containers may be stacked in partially nested relationship at an intermediate level and at a higher upper level relative to each other. Examples of such prior art containers are found in U.S. Pat. No. 3,951,265 and in a commonly owned co-pending application Ser. No. 103,205 of Edwin L. Stahl et al, filed Dec. 13, 1979.

The present invention is especially directed to improvements on the container disclosed in the aforementioned application Ser. No. 103,205, by means of which four-level stacking can be achieved.

SUMMARY OF THE INVENTION

The container according to the present invention is an open topped, tray-like container preferably formed as a one-piece unit of molded plastic material. The container is so constructed that a like container may be lowered into the open top of an underlying container into a nested relationship where the uppermost container is quite deeply nested within the lower container. Rod-like bale members having crank arms at their opposed ends are pivotally mounted within slots located at opposite ends of opposed end walls of the container, the rod-like bale member extending parallel to its associated end wall. The configuration of the slots is such that the pivot pins of the bale members received within the slots are located in stable rest positions when the pins are at either end of the slots. When in either of these rest positions, the pin allows the bale member to be pivoted to either of two alternative rest positions relative to the container, thus resulting in four possible positions of the rod-like bale member relative to its end wall. When in one of these rest positions, the bale member is so positioned as to permit passage of a like container downwardly past the bale members to the fully nested position. The other three rest positions of the bale member find the bale member at different elevations relative to its container and in a position in which the bale member will engage the bottom of a like container to support the like container at a selected elevation relative to the underlying container, depending upon the particular rest position in which the bale member is located. Bale member receiving notches are formed on the bottom of the container to correspond to each of the rest positions of the bale member.

Other objects and features of the invention will become apparent by reference to the following specification and to the drawings.

IN THE DRAWINGS

Figure 1:
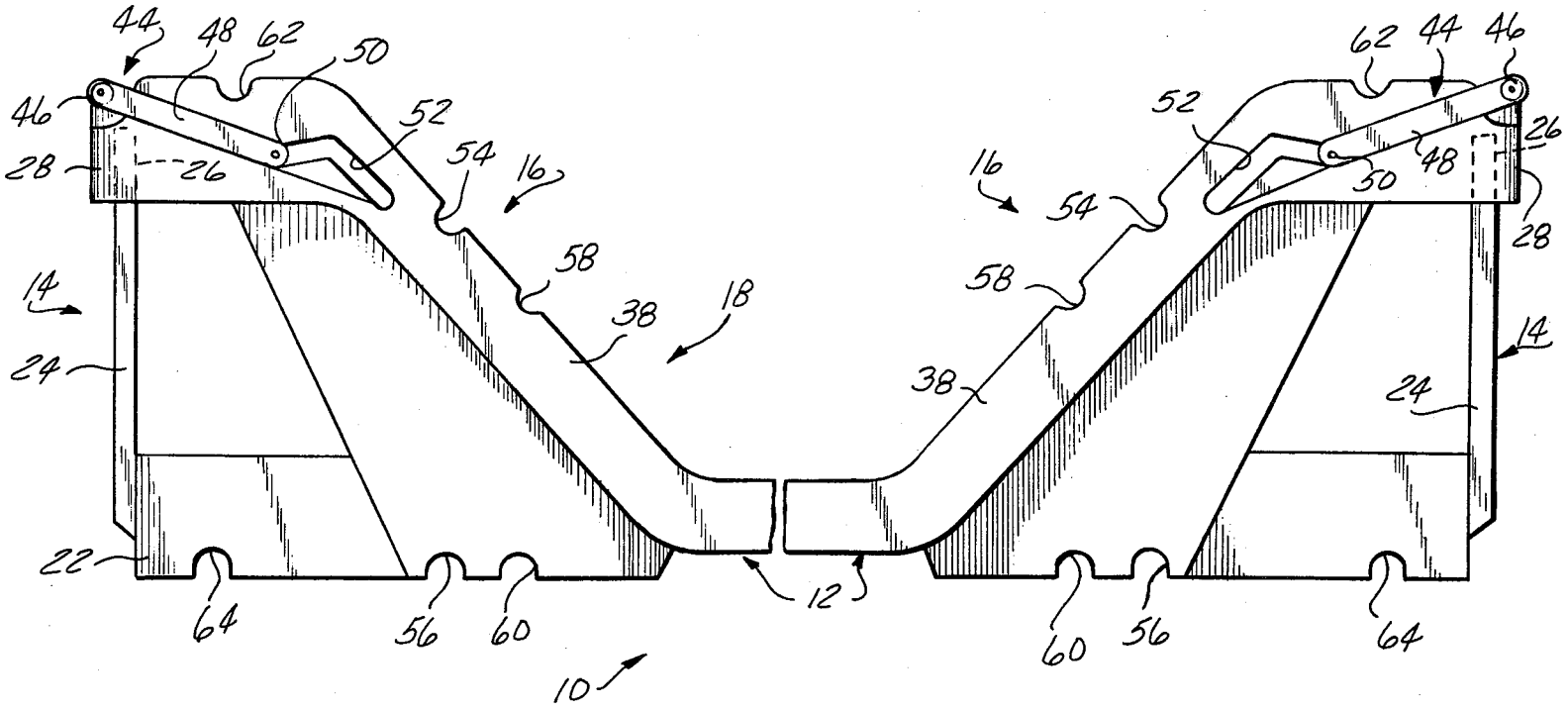
FIG. 1 is a side elevational view of a container embodying the present invention, with certain parts broken away.
Figure 2:
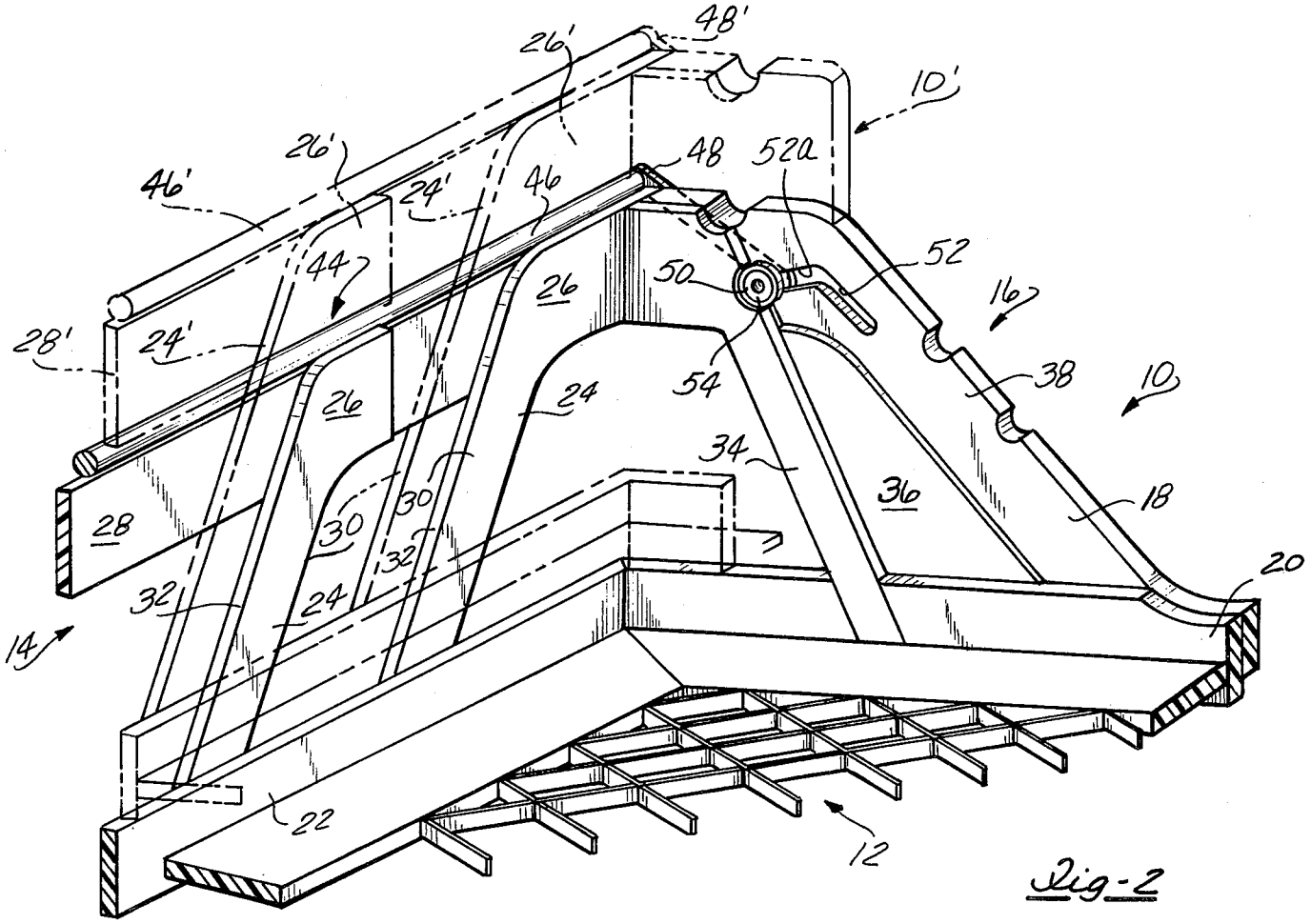
FIG. 2 is a perspective view looking downwardly and inwardly into one corner of the interior of the container of FIG. 1, and partially indicating in broken line a like container in nested relationship.

The overall construction of a container embodying the present invention is best seen in FIGS. 1 and 2 of the drawings. The container is designated generally 10 and includes a flat bottom 12 of rectangular shape having opposed end walls designated generally 14 projecting upwardly from opposite ends of the bottom. At the opposite end of each end wall 14, a gusset-like side wall portion 16 projects from end wall 14 a relatively short distance along the side of bottom 12. A downwardly inclined section 18 on portion 16 merges with the main portion 20 of the container side walls which project upwardly only a relatively small distance above bottom 12. This arrangement, as best seen in FIG. 1, provides a relatively deep recess in the container side walls between the opposed inclined edges 18 which assists in guiding like containers to their fully nested position in a manner to be described below.

The structure described thus far is preferably a unitary one-piece element which may be conveniently molded from a suitable plastic material such as polyethylene or similar materials.

Referring now particularly to FIG. 2, it is seen that each end wall 14 is made up of what might be best referred to as three elements, even though these elements are in fact one integral piece. At its lower portion, end wall 14 includes a bottom strip 22 which projects upwardly a relatively short distance above bottom 12. From the upper side of bottom strip 22, a plurality of spaced slats 24 project upwardly at an inclination to the vertical and are formed with generally horizontally extending toe sections 26 at their upper end. Integrally secured to the outer sides of the toe sections 26 is an upper side rail 28.

Referring particularly to FIG. 1, it is seen that in side elevation, slats 24 are of uniform thickness and are disposed on the outer side of bottom strip 22, while upper rail 28 in turn is disposed at the outer side of slats 24. Returning to FIG. 2, it is seen that the toe section 26 of the respective slats are spaced from each other so that when a like container, indicated in broken line at 10' in FIG. 2, is moved into nested relationship with a lower container, the slats 24' of the upper container can pass downwardly between the adjacent toe portions 26 of the underlying slats until the inclined bottom edges 30' of the slats of the upper container rest upon the correspondingly inclined upper edges 32 of the slats of the lower container.

Figure 3:
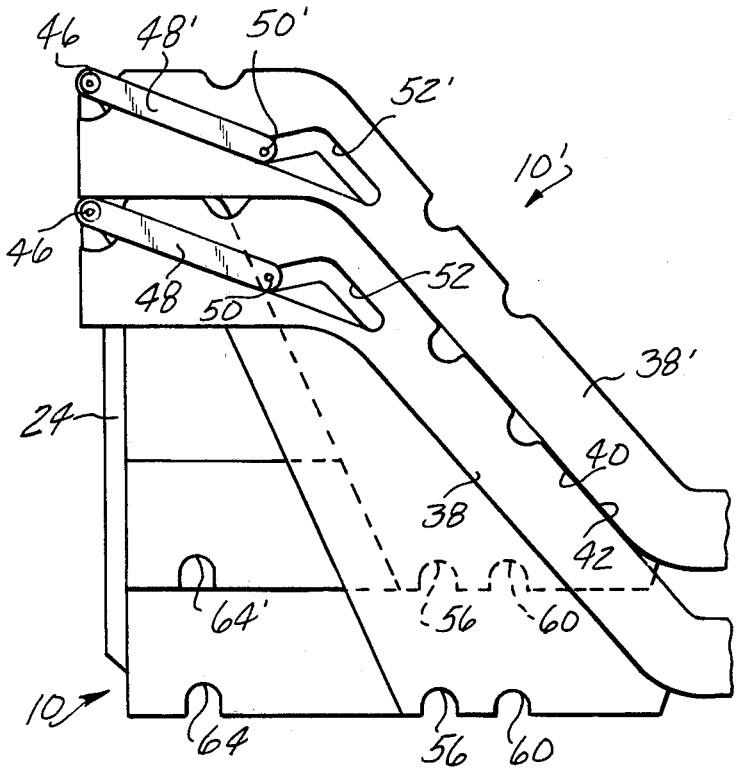
FIG. 3 is a detailed, partial side elevational view showing one end of two nested containers in their fully nested position.

A generally similar arrangement is employed on the gusset-like end section 16 of the container side walls. Referring to FIG. 2, it is seen that the sections 16 include an upwardly inclined brace 34 which is inwardly offset from a central web 36 which in turn is inwardly offset from a main seating section 38. As best seen in FIG. 3, when two containers are in nested relationship, the lower edge of the seating section 38' of the upper of the two containers rests on the upper edge 42 of the seating section 38 of the lower container.

The capability of multi-level stacking of two like containers is achieved by means of a pair of bales designated generally 44, one mounted on each end wall of the container. Each bale 44 includes a rod-like bale member 46 which extends the entire length of each end wall of the container. At each end of bale member 46 a crank 48 is fixedly secured to the bale member to extend radially from bale member 46, the cranks 48 at opposite ends of the bale extending parallel to each other. At the opposite end of each crank 44, a pivot pin 50 projects from the inner side of the crank to pass through a slot 52 in gusset section 38. An enlarged head 54 is secured to the inner end of pivot pin 50 to retain the bale in assembled relationship with the container, while accommodating sliding movement of the pivot pin 50 along its associated slot 52.

As best seen in FIG. 1, the slots 52 are of a rather shallow, inverted V-shaped configuration with the opposed ends of the slots both being at a lower elevation than the apex of the V. Thus, when the pivot pin 50 is located at either end of the slot, it is at a gravitationally maintained rest position. By providing additional inclined slots at different levels parallel to the slot section 52*a*, additional rest positions for the bale pins 50 may be established.

The bale may be pivoted relative to the container about the axis defined by its two pins 50 and, when the pivot pins 50 are seated at either end of their associated slots 52, the rod-like main bale member 44 may be selectively pivoted to either of two positions relative to the container. In FIG. 1, the bales 44 are located with their respective pivot pins 50 at what will be referred to as the upper end of their respective slots 52, and the bale member portion 46 of the respective bales 44 is disposed at what will be termed an outer rest position in which the rod-like bale members 46 rest upon the upper edge of top rail 28. In this position, the bale member 46 is disposed outwardly of the outer sides of slats 24 so that a second container can be lowered into the container in FIG. 1 with the slats of the two opposed end walls of the container being lowered passing inside the bale members 46 of the lower container as shown in FIG. 1. When so lowered, two containers will be placed in a fully nested position shown in FIG. 3.

Although the slats 24 of the upper container as viewed in FIG. 3 are vertically aligned with the slats 24 of the lower container, the inclination and spacing between the upper ends of the slats 24 as described above enable the two containers to be moved to the fully nested position of FIG. 3. In this position, the upper container finds the lower edges of its seating sections 38 being seated on the upper edges 42 of the seating sections 38 of the lower of the two containers.

Figure 5:
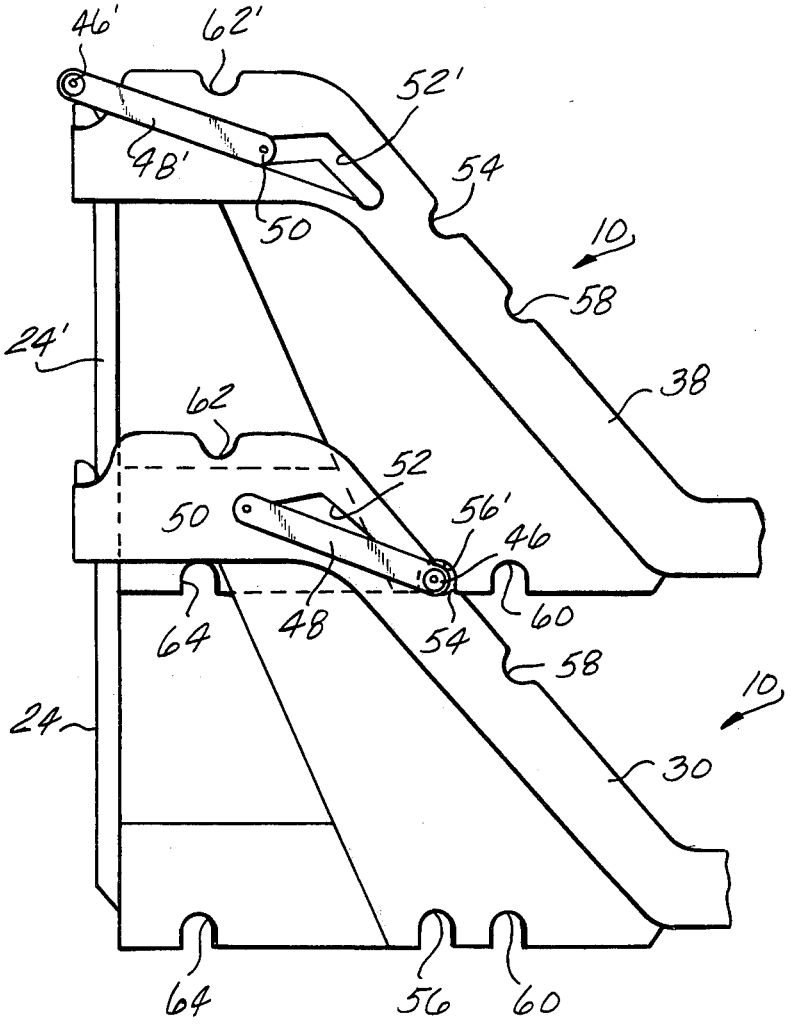
FIG. 5 is a view similar to FIG. 3 showing the two nested containers in a second intermediate stacked position.

Referring now to FIG. 5, it is seen that the bale 44 still has its pivot pins 50 located at the upper end of slot 52, but in FIG. 5 the bale has been pivoted from the position shown in FIG. 1 to a second rest position relative to the container in which the rod-like bale member is now seated within a notch 54 formed on the upper edge 42 of seating section 38. When the bale 44 is in the position shown in FIG. 5, a second container 10' will be supported upon the lower container 10 in the relationship shown, the upper container 10' having a notch 56 in its bottom which receives the bale member 46 when the bale member is in the position shown in FIG. 5. It will be observed that the upper container 10' is now supported in a partially nested position which is at a substantially higher level relative to the first or lower container 10 than was the case in the fully nested relationship shown in FIG. 3.

Figure 4:
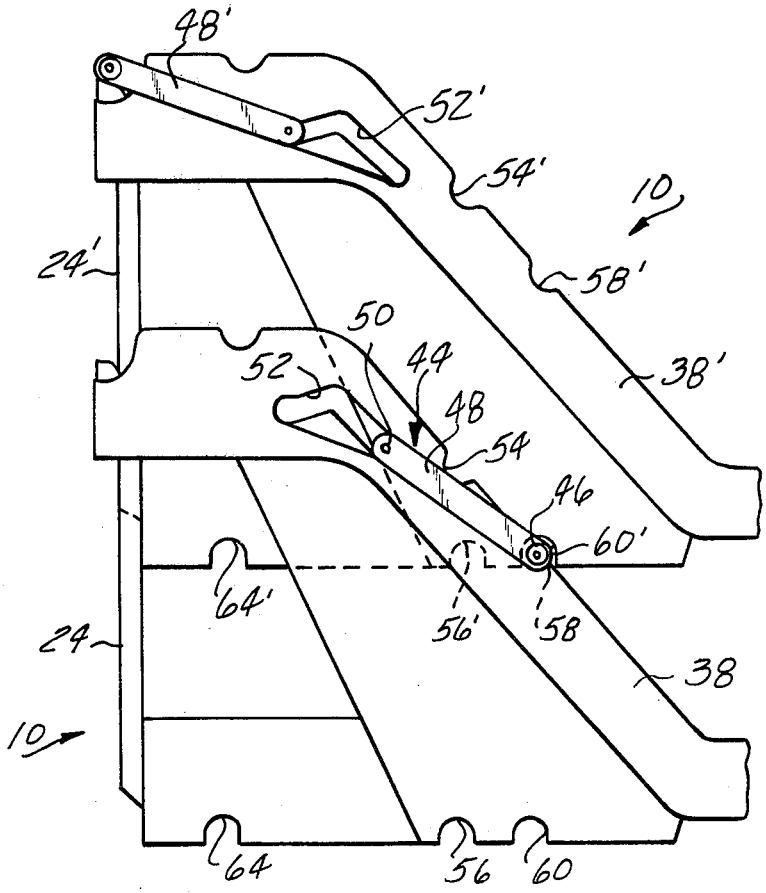
FIG. 4 is a view similar to FIG. 1 showing the two nested containers at a first intermediate stacked position.

Referring now to FIG. 4, it is seen that the bale 44 has been shifted relatively to the lower container 10 so that its pivot pins 50 are now located at a rest position at the lower ends of the respective slots 52. Bale member 46 is seated in a notch 58 in seating section 38 which is at a lower elevation than was notch 54, and an upper container 10' rests upon the bale in this position with a notch 60' on its bottom receiving bale member 46. The partially nested position illustrated in FIG. 4 is an intermediate level stacking position which is above the fully nested relationship shown in FIG. 3, but below the intermediate stacking level position shown in FIG. 5.

Figure 6:
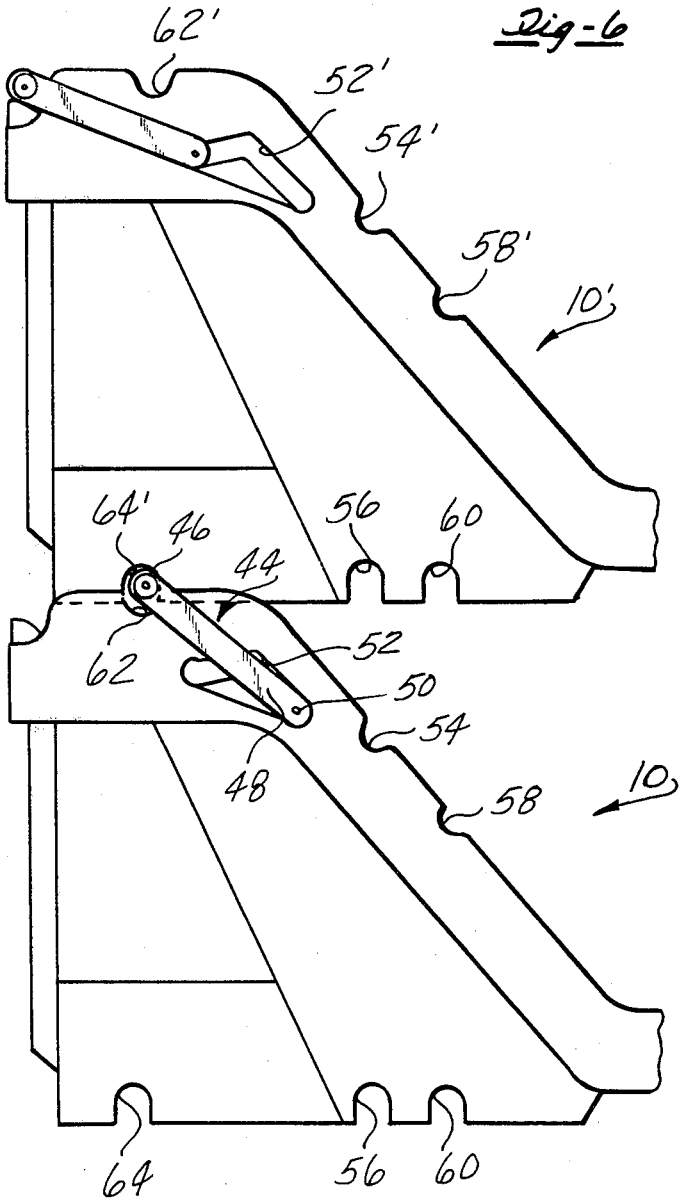
FIG. 6 is a view similar to FIG. 3 showing the two containers at an upper stacked position.

Finally, in FIG. 6, the two containers 10 and 10' are shown in their upper stacked position. The pins 50 of bale 44 are located at their lower rest positions at the loweer end of slot 52, while the bale member 46 is seated in a notch 62 at the top of seating section 38 and received within a downwardly opening notch 64' in the bottom of the upper container 10'.

From the foregoing, it is believed apparent that the arrangement described enables the stacking of two like containers at four different levels relative to each other simply by locating the bale members 46 in the positions as described.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

We claim:

1. In an open topped, stackable container including a bottom, a pair of end walls projecting upwardly from said bottom at opposite ends thereof, said end walls having means thereon accommodating the vertical nesting of one of said containers within another like container in a fully nested storage relationship, and bale means on said end walls selectively locatable in any of a plurality of positions relative to said end walls to selectively establish different depths to which said another like container may be nested within said one container;

the improvement wherein said bale member comprises an elongate rod-like bale member extending parallel to each end wall, crank means fixed at one end to each end of said bale member, aligned pivot means for establishing a pivotal axis parallel to and offset from said bale member at the opposite end of said crank means from said bale member, coupling means on said end walls receiving said pivot means for pivotal movement of said bale member about said axis relative to the associated end wall and for sliding movement wherein said bale member is movable relative to said end walls in directions normal to said axis, said coupling means including means defining at least two spaced stable rest positions of said pivot means relative to said end wall, means on said end wall selectively engageable with said bale member when said pivot means is in any one of said stable rest positions to establish two alternative rest positions of said bale member at different levels relative to said end wall for each of the two stable rest positions of said pivot means and wherein one of said rest positions of said bale member locates said bale member outwardly of vertical alignment with the bottom of said container whereby a like container may be lowered downwardly past said bale member into said fully nested storage relationship, said bale member when located in any of its three other rest positions being located in overlying relationship with said bottom of said container, and means defining a series of three spaced bale member receiving notches in the bottom of said container respectively located in vertical alignment with said three other bale member rest positions, whereby a like container may be stacked upon said container at any of four different levels as determined by the rest position occupied by said bale member.

2. The invention defined in claim 1 wherein each of said end walls comprises a gusset-like side section extending from each end of the end wall along the side of the container, each of said side sections having an upper edge including an inclined edge section extending downwardly away from said end wall, and means defining a plurality of bale member receiving notches in said upper edge engageable with said bale member to retain said bale member respectively in said other bale member rest positions.

3. The invention defined in claim 2 wherein said coupling means comprises means defining a slot in said side section having a first slot section terminating at a lower end establishing one of said stable rest positions of said pivot means, and a laterally offset slot section intersecting said first slot section at a location vertically displaced above said lower end establishing another of said stable rest positions of said pivot means.

* * * * *